US006959813B2

(12) United States Patent
Colby

(10) Patent No.: US 6,959,813 B2
(45) Date of Patent: Nov. 1, 2005

(54) CORRUGATED CONTAINER

(75) Inventor: D. Scot Colby, Elk Grove Village, IL (US)

(73) Assignee: Fuji Hunt Photographic Chemicals, Inc., Rolling Meadows, IL (US)

( * ) Notice: Subject to any disclaimer, the term of this patent is extended or adjusted under 35 U.S.C. 154(b) by 216 days.

(21) Appl. No.: 10/397,410

(22) Filed: Mar. 26, 2003

(65) Prior Publication Data

US 2003/0189088 A1 Oct. 9, 2003

Related U.S. Application Data

(62) Division of application No. 09/793,865, filed on Feb. 27, 2001, now Pat. No. 6,561,413.

(51) Int. Cl.[7] ..... B65D 85/00

(52) U.S. Cl. ..... 206/526; 206/427; 229/132; 229/198.2

(58) Field of Search ..... 206/139, 145, 206/147, 151, 427, 443, 194, 199, 7, 526, 206/774; 229/132, 183, 185, 190, 155, 198.2

(56) References Cited

U.S. PATENT DOCUMENTS

| | | | | |
|---|---|---|---|---|
| 1,236,444 A | * | 8/1917 | Jones | 493/59 |
| 1,811,135 A | * | 6/1931 | Knowlton | 229/182 |
| 2,256,834 A | * | 9/1941 | Mandel | 229/125.39 |
| 2,588,791 A | * | 3/1952 | Andrew, Jr. | 206/392 |
| 2,827,165 A | * | 3/1958 | Gentry | 206/434 |
| 2,950,041 A | * | 8/1960 | Stone | 206/147 |
| 3,198,378 A | * | 8/1965 | Farquhar | 206/194 |
| 3,337,046 A | * | 8/1967 | Marcel et al. | 206/194 |
| 3,394,800 A | * | 7/1968 | Brackett et al. | 206/196 |
| 3,425,542 A | * | 2/1969 | Bolen | 206/432 |
| 3,432,086 A | * | 3/1969 | Galloway et al. | 229/126 |
| 3,822,822 A | * | 7/1974 | Arneson | 206/161 |
| 3,899,076 A | * | 8/1975 | Florian | 206/427 |
| 4,206,869 A | | 6/1980 | Gurevitz | |
| 4,225,078 A | | 9/1980 | Croley | |
| 4,690,282 A | | 9/1987 | Ghini | |
| 4,771,939 A | * | 9/1988 | Wilkins | 229/132 |
| 4,899,927 A | | 2/1990 | Straub et al. | |
| 5,046,662 A | | 9/1991 | Cowles | |
| 5,139,196 A | | 8/1992 | Fry et al. | |
| 5,369,938 A | | 12/1994 | Panveno et al. | |

(Continued)

FOREIGN PATENT DOCUMENTS

CH CH 674189 * 5/1990 ..... B65D 5/20

*Primary Examiner*—Mickey Yu
*Assistant Examiner*—Jerrold Johnson
(74) *Attorney, Agent, or Firm*—Meroni & Meroni, P.C.; Charles F. Meroni, Jr.

(57) ABSTRACT

A self-squaring corrugated container employs alignment markings on and adjacent to the manufacturing joint to allow quick visual inspection of placement and orientation of the manufacturing joint, and employs interlocking contoured peripheral edges on the major bottom flaps to allow consistent, quick, and easy formation of a container which is square, non-skewed to within small, strict tolerances. Both the alignment markings and contoured bottom flaps are die cut into the carton blank to insure uniform container alignment. Additional container features include employment of a hinged, partially detached top flap to accommodate use of the container to packaged bottles. Method steps are provided for forming the self-squaring container using the innovative features.

2 Claims, 8 Drawing Sheets

U.S. PATENT DOCUMENTS 5,390,790 A 2/1995 Straub
5,487,463 A * 1/1996 Harris ..... 206/145
5,530,531 A * 6/1996 Girard ..... 399/120
5,624,070 A 4/1997 Gueniot
5,690,274 A 11/1997 Yang
5,938,111 A 8/1999 Grigsby

* cited by examiner

CORRUGATED CONTAINER

This is a Divisional Application of U.S. patent application Ser. No. 09/793,865 filed Feb. 27, 2001, now U.S. Pat. No. 6,561,413.

BACKGROUND OF THE INVENTION

In product packaging using corrugated containers, formation of containers having flaps which are correctly aligned and non-skewed is required to meet manufacturer specifications and to provide packaging which is secure, protective, and of pleasing appearance. Certain applications require containers which are consistently and uniformly square and non-skewed. One such application is the use of corrugated containers to package bottled photographic processing chemicals, where the both the container and its bottled chemicals are inserted into a dedicated opening within a photographic processing machine. In this application, the container must be square and non-skewed within extremely tight tolerances. If the container is malformed, that is, out of square and or skewed out side of the required tolerances, it will not fit into the dedicated opening. Containers which are formed nearly within the required tolerances may possibly be inserted within the dedicated opening, but the chemicals may not be correctly aligned within the machine, causing machine malfunction.

Conventional rectangular corrugated containers are typically manufactured from a single piece of corrugated board, corrugated board, or similar material. They are die cut into a blank having a predetermined pattern and provided with indented fold lines to facilitate folding into a rectangular container. The container manufacturer usually folds the corrugated board blank along two of the fold lines so as to overlap and seal the leading and trailing lateral edges, forming a manufacturing joint. This process results in a flattened, or knock-down, product. A random sample of knocked-down containers are inspected by manual measurement using a ruler to insure that the product is formed to packager specifications and within required tolerances. Once the measurements are complete, the measured results are compared to the specifications. Containers measuring within the specifications are retained, and all remaining containers are discarded. Typically, product is shipped to the packaging facility in this compact, knocked-down form.

In instances where consistent and uniformly square and non-skewed containers are required, samples of the knocked-down corrugated board product are again inspected upon arrival at the packaging facility, and additional samples are inspected prior to use on forming-and-filling assembly lines. Upon passing inspections, the knocked-down corrugated board product is erected into a hollow tubular shape, filled, and then the bottom and top flaps are folded and sealed.

In this manufacturing process, there are two stages at which the quality of square and skew of the container are determined. The first stage is the folding of the corrugated board blank to form the manufacturing joint. If the blank is over folded, under folded, or folded so that the edges are not correctly aligned, the resulting container will not be square or will be skewed, or a combination of both. The second stage is when the bottom and top flaps of the tubular, filled container are folded and sealed. If these flaps are not correctly aligned with each other and with the side walls of the container, the container will not be square or will be skewed, or a combination of both. Typically, manufacturers of corrugated containers have difficulty providing containers which are properly aligned and non-skewed, and have no simple way to see that each and every container meets specifications.

Improvements in container design which allow containers to be more easily formed having square and aligned components would greatly improve packaging efficiency and quality. Specifically, a container design which addresses the issue of improvements in consistency in formation of both the manufacturing joint and the top and bottom flap fold are key to creating a consistently and uniformly square and non-skewed corrugated container.

SUMMARY OF THE INVENTION

An innovative self-squaring corrugated container is disclosed herein which employs alignment markings on and adjacent to the manufacturing joint to allow quick visual inspection of placement and orientation of the manufacturing joint, thus eliminating the need for manual inspection of knocked down containers using rulers or other external measurement tools and which would allow every person handling the container, from line operator to quality control inspector, to visually check that containers meet manufacturing specifications. The container further employs interlocking contoured peripheral edges on the major bottom flaps to allow consistent, quick, and easy formation of a container which is square and non-skewed to within small, strict tolerances. As the container is formed, the interlocking finger-like projections of the respective bottom flaps engage each other and automatically squarely align and lock the flaps in such a way as to prevent relative motion between the bottom flaps, preventing the squarely formed container from skewing. Both the alignment markings and contoured bottom flaps are die cut into the carton blank to insure uniform container alignment.

Additional container features include employment of a hinged, partially detached top flap to accommodate use of the container to packaged bottles.

Method steps are provided for forming the self-squaring container using the innovative features.

DETAILED DESCRIPTION

Figure 1:
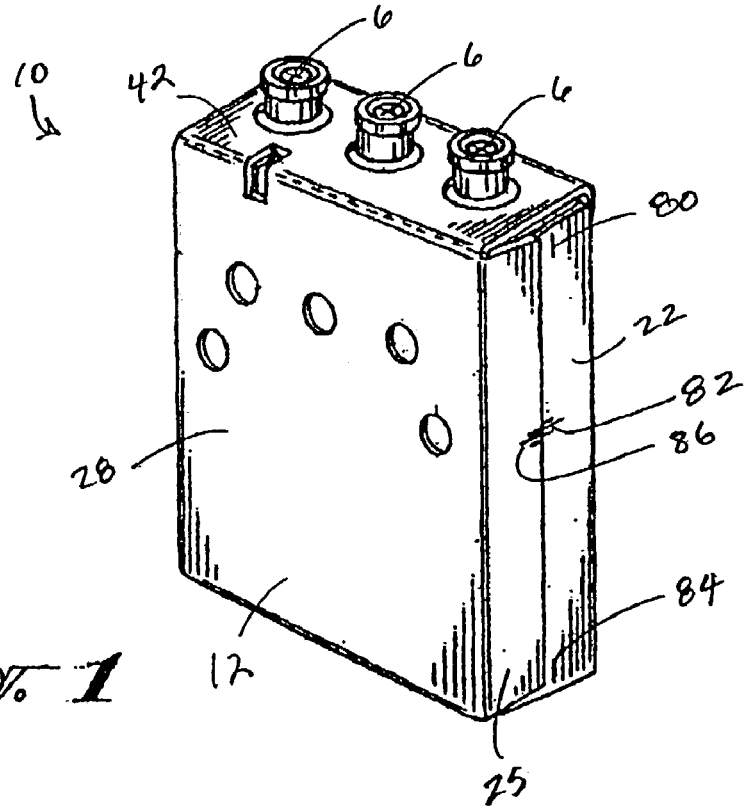
FIG. 1 is a front perspective view of the preferred embodiment of the fully formed and filled inventive container, illustrating alignment markings along the manufacturing joint on the front minor side of the container.
Figure 2:
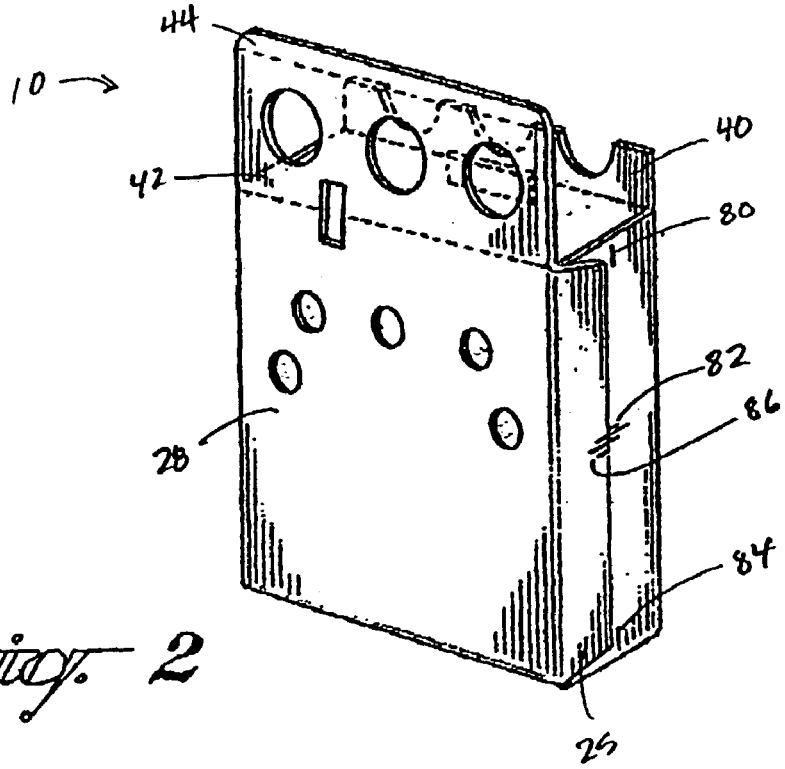
FIG. 2 is a front perspective view of the container of FIG. 1 showing the non-folded upper flaps to illustrate the die cuts in both upper flaps which accommodate the bottle caps and necks.

To accommodate the use of a consistently square and non-skewed container 10 to package bottled photographic processing chemicals, where container 10 and the enclosed bottled photographic chemicals are inserted as a unit into a photographic processing machine, container 10 is provided with several innovative design features. In this application, the bottles 5 are provided with a necked portion 7 which receives a cap or bottle closure 6, where cap 6 is much larger in diameter than neck 7. Neck 7 and cap 6 extend above the top edge of container 10 when container 10 is completely folded (FIG. 1).

Improvements in container design, which are not limited to this specific application and may be applied generally to container manufacturing, include use of alignment markings and interlocking contoured peripheral edges on bottom flaps to allow consistent, quick, and easy formation of a container which is square, non-skewed to within small, strict tolerances. Improvements in container design, specific to the use of a consistently square and non-skewed carton to package bottled photographic processing chemicals for use in photographic processing machines, and which also has general applications, consist of the following: Rear side top flap 40 is detached from rear side wall 24 except at hinge 65, rear side top flap 40 is provided with semicircular openings 92 in its peripheral edge to receive and surround the necks 7 of bottles 5, and front side top flap 42 is provided with circular openings 90 to allow the caps 6 of bottles 5 to pass therethrough.

Figure 5:
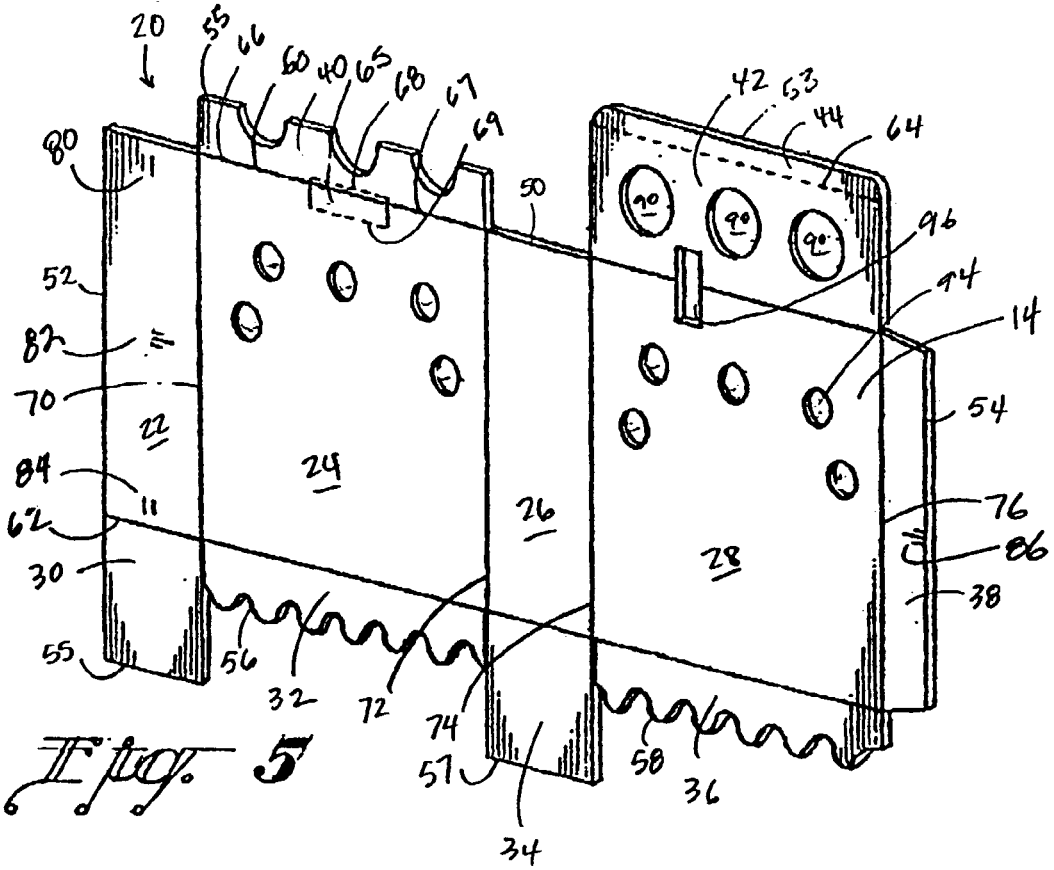
FIG. 5 is a plan view of the die-cut blank from which the container of FIG. 1 is formed, illustrating the placement of alignment markings on the minor sides, and illustrating the contoured peripheral edges of the major bottom flaps.

Referring now to the drawings, and initially to FIGS. 1 and 5, the inventive container 10 is formed by die cutting blank 20 from a sheet of corrugated board stock. This corrugated board stock may be paper board, or plastic board, and may be of single- or multiple-ply. The preferred material is a single-ply corrugated board of 3.1 mm (0.122 inch) thickness. However, it is well within the scope of this invention to use corrugated board of approximately two or three times this thickness. It is also well within the scope of this invention to use corrugated board which is as thin as 0.47 mm (1/64 inch) thickness.

Blank 20 has a predetermined, generally rectangular pattern and is provided with plural indented longitudinal and transverse fold lines to facilitate folding into a container. The indented longitudinal fold lines extend parallel to the longitudinal axis of container 10, and the indented transverse fold lines extend perpendicularly to the indented longitudinal fold lines. Each blank 20 is provided with a first longitudinal fold line 70 which separates the first end wall 22 from the rear side wall 24, a second longitudinal fold line 72 which separates the rear side wall 24 from the second end wall 26, a third longitudinal fold line 74 which separates the second end wall 26 from the front side wall 28, and a fourth longitudinal fold line 76 which separates the front side wall 28 from the end wall flange 38.

Each blank 20 is further provided with an upper transverse fold line 60 and a lower transverse fold line 62. Upper transverse fold line 60 defines the upper edge of container 10 and separates the rear side top flap 40 from the rear side wall 24, and separates the front side top flap 42 from the front side wall 28. The lower transverse fold line 62 defines the lower edge of the container and hingedly separates the rear side bottom flap 32 from the rear side wall 24, hingedly separates the front side bottom flap 36 from the front side wall 28, hingedly separates the first end bottom flap 30 from the first end wall 22, and hingedly separates the second end bottom flap 34 from the second end wall 26.

Blank 20 is provided with a first face 12 which corresponds to the exterior surface of the container, and a second face 14 which is opposed to the first face and which corresponds to the interior surface of the container. The respective first 12 and second faces 14 are spaced apart from each a distance which corresponds to the thickness of the corrugated board sheet.

Figure 12:
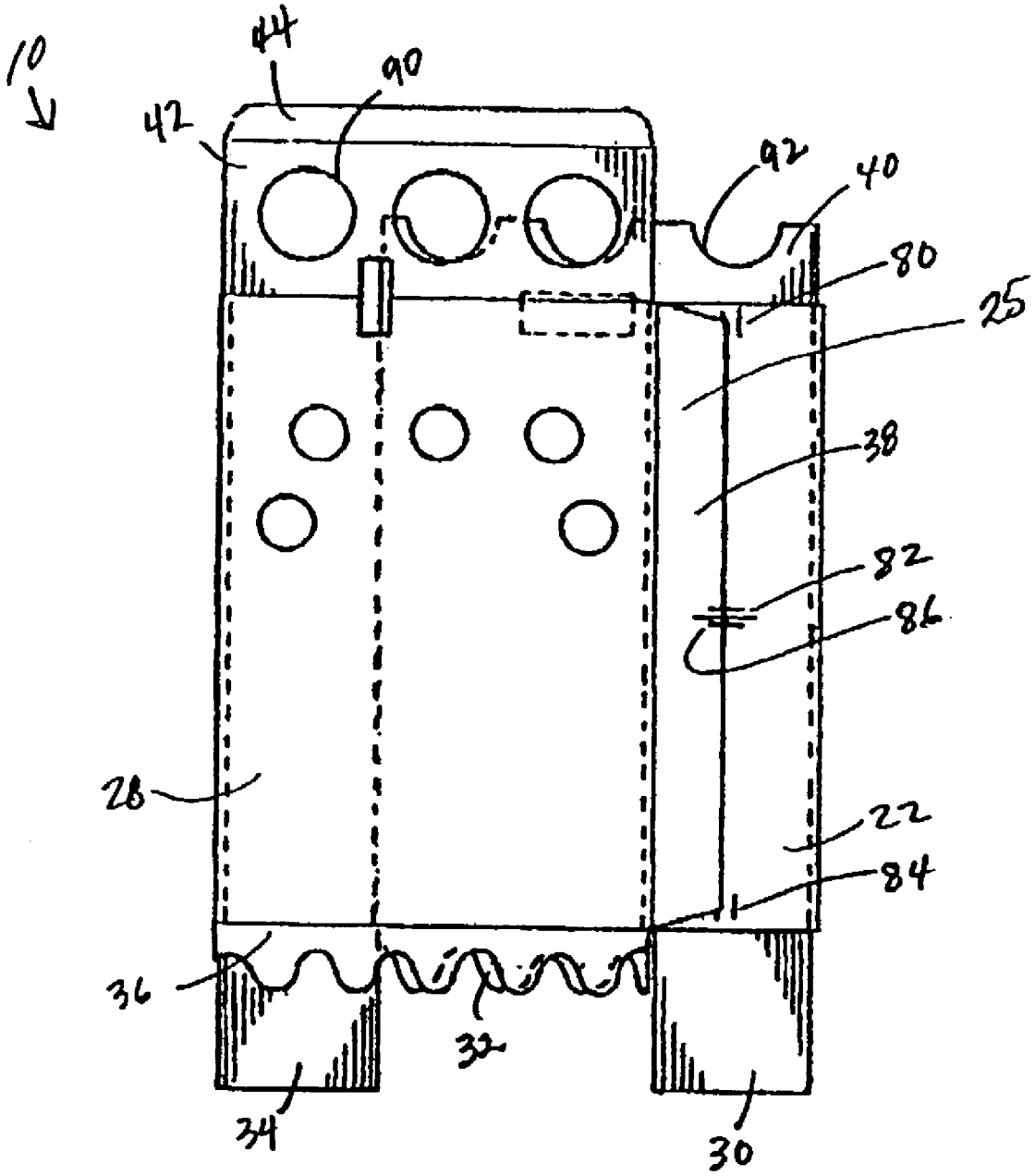
FIG. 12 is a plan view of the blank of FIGS. 5 and 11, illustrating the trailing flap and portion of the body of the blank folded forward to overlie the body of the blank, as well as the leading flap, to form the manufacturing joint as a third step in the manufacture of a knocked-down container.

Container 10 is provided by the manufacturer in a knocked-down, or flattened, tubular configuration (FIG. 12). Blank 20 is formed into this tubular configuration as follows: Blank 20 is folded along first longitudinal fold line 70 so that second face 14 of first end wall 22 overlies and confronts a portion of second face 14 of rear side wall 24 adjacent first longitudinal fold line 70. Blank 20 is then folded along third longitudinal fold line 74 so that second face 14 of front side wall 28 overlies and confronts second face 14 of second end wall 26 and a second portion of rear side wall 24, and so that second face 14 of end wall flange 38 overlies first face 12 of first end wall 22. Second face 14 of end wall flange 38 is secured to the first face of the first end wall. Securement is accomplished by any conventional means, preferably by application of glue between end wall flange 38 and first end wall 22. This securement of opposed lateral ends of blank 20 results in what is known as manufacturing joint 25.

Alignment markings are die cut into blank 20 at strategic locations so as to allow instant visual determination of whether a knocked-down container has a properly aligned manufacturing joint. Four sets 80, 82, 84, 86 of alignment markings are provided on blank 20 in the region of manufacturing joint 25.

The first set 80 of alignment markings is located on first end wall 22 adjacent to but spaced apart from its top edge, or upper transverse fold line 60. The second set 82 of alignment markings is located on first end wall 22 adjacent to but spaced apart from its bottom edge, or lower transverse fold line 62. First set 80 and second set 82 are identical and are longitudinally aligned on first end wall 22. Each respective first set 80 and second set 82 consists of two parallel cut lines which are aligned with the longitudinal axis of container 10. The two lines are adjacent to each other and spaced apart a first distance.

Figure 13:
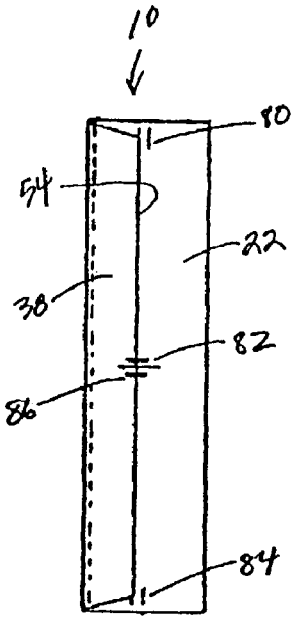
FIG. 13 is a minor side view of the erected, folded container, illustrating the correct interrelationship between the manufacturing joint and a first embodiment of the alignment markings.

The first set 80 and second set 82 of alignment markings are located and oriented on blank 20 so that when manufacturing joint 25 is correctly formed, the longitudinally aligned peripheral edge 54 of end wall flange 38 resides between the two lines of both first set 80 and second set 82 (FIG. 13). Thus, the markings of first set 80 and second set 82 provide a measure of transverse tolerance for placement of manufacturing joint 25, as well as defining a range of allowable positions for joint placement in the transverse direction. The first distance, or relative spacing of the two markings, is determined by the allowable transverse error in placement of end wall flange 38 on first end wall 22. In the preferred embodiment, this first distance is 5 mm. However, the first distance is dependent on the specific requirements of a given application, and thus may be greater than 5 mm in applications which container shape is less critical, and may be less than 5 mm in applications in which container shape is more critical.

Figure 14:
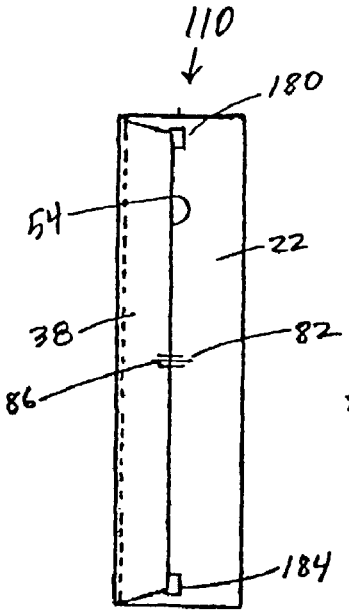
FIG. 14 is a minor side view of the erected, folded container, illustrating the correct interrelationship between the manufacturing joint and a second embodiment of the alignment markings.
Figure 15:
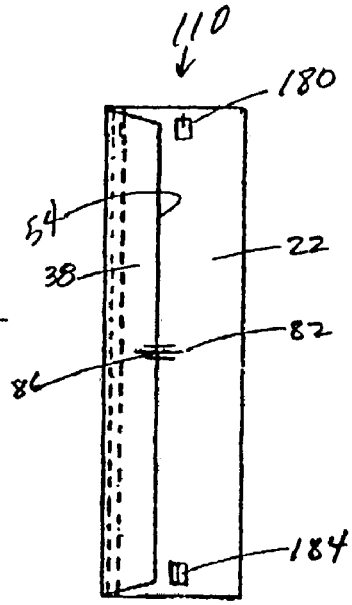
FIG. 15 is a minor side view of the erected, folded container, illustrating one possible incorrect interrelationship between the manufacturing joint and the alignment markings of FIG. 14, wherein the manufacturing joint is correctly aligned in the vertical direction, but is incorrectly aligned laterally.
Figure 16:
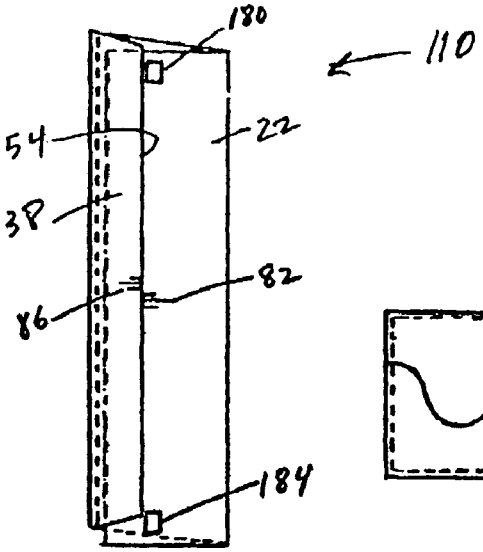
FIG. 16 is a minor side view of the erected, folded container, illustrating a second possible incorrect interrelationship between the manufacturing joint and the alignment markings of FIG. 14, wherein the manufacturing joint is incorrectly aligned in both the vertical and lateral directions.

FIGS. 14–16 disclose a second embodiment 180, 184 of the first set 80 and the second set 84 of alignment markings. In this second embodiment, the pair of parallel, longitudinally aligned cut lines is replaced with a rectangular shaped through cut hole. The rectangular hole is oriented on first end wall 22 such that the longitudinal axis of the rectangle is aligned with the longitudinal axis of container 10. The transverse dimension of the rectangular hole is equal to the first distance, that is, it is determined by the allowable transverse error in placement of end wall flange 38 on first end wall 22. Use of a through cut rectangular hole provides improved visualization of the markings, and their positional relationship to the manufacturing joint 25.

The third set 84 of alignment markings is centered on first end wall 22 such that it lies midway between the upper and lower transverse fold lines 60, 62, and such that it lies midway between first longitudinal fold line 70 and the longitudinally aligned peripheral edge 52 of first end wall 22. Third set 84 consists of three transversely aligned parallel lines: An upper marking, a center marking, and a lower marking. The upper marking and lower marking are each spaced apart a second distance from the center marking. The center marking is slightly longer than the upper and lower markings to improve visual differentiation between the three markings.

The fourth set 86 of alignment markings is located on end wall flange 38 such that it coincides with and extends inward from the longitudinally aligned peripheral edge 54 of end wall flange 38, and is located midway between the upper and lower transverse fold lines 60, 62. Fourth set 86 also consists of three transversely aligned parallel lines comprising three markings, the three markings comprising an upper marking, a center marking, and a lower marking. The upper marking and lower marking are each spaced apart a second distance from the center marking. The center marking is slightly longer than the upper and lower markings to improve visual differentiation between the three markings.

The third 84 and fourth 86 sets of alignment markings are located and oriented on blank 20 so that when manufacturing joint 25 is correctly formed, the three markings of third set 84 are transversely aligned with the three markings of fourth set 86. Specifically, the center line of third set 84 must lie between the upper and lower markings of fourth set 86, and the center line of fourth set 86 must lie between the upper and lower markings of third set 84 (FIGS. 13–15). Thus, the markings of third set 84 and fourth set 86 provide a measure of longitudinal tolerance for placement of manufacturing joint 25, as well as defining a range of allowable positions for joint placement in the longitudinal direction. The second distance, or relative spacing of the three markings, is determined by the allowable longitudinal error in placement of end wall flange 38 on first end wall 22. In the preferred embodiment, this second distance is 3 mm. However, the second distance is dependent on the specific requirements of a given application, and thus may be greater in applications which container shape is less critical, and may be less in applications in which container shape is more critical.

Use of differing styles of alignment markings at different locations about manufacturing joint 25 is directly related to the criticality of the alignment at that location. Specifically, the three transversely aligned parallel lines of the third 84 and fourth 86 alignment sets provide a more fine gauge than the two longitudinally aligned parallel lines of the first 82 and second 84 alignment sets. However, it is within the scope of this invention to substitute a set of two transversely aligned parallel lines for the three-line embodiment of the third 84 and fourth 86 alignment sets, so that all four alignment sets 80, 82, 84, 86 are identical. It is also within the scope of the invention to use the three-line paradigm for all four alignment sets.

In the preferred embodiment, the cut lines of each respective set of alignment markings are die cut completely through blank 20 such that both first face 12 and second face 14 are marked. By die cutting the markings into blank 20 concurrent with formation of blank 20, the markings are inherently properly aligned with the longitudinal and transverse axes of blank 20. Alignment errors which would be introduced in a two-step marking process, such as in the case of stamping out blank 20 and then imprinting alignment markings thereon, are avoided in this preferred embodiment. Die cutting the alignment markings completely through blank 20 also allows inspection of the carton from either the inside or the outside. However, it is well within the scope of this invention to die cut the alignment markings so that the cut line extends only partially through the thickness of the blank, as may be more practical when the blank is formed of very thick stock.

Improper alignment of manufacturing joint 25 is immediately determined by visual inspection. If the longitudinally aligned peripheral edge 54 of end wall flange 38 does not reside between the two lines of either first set 80 and/or second set 82 (FIGS. 15 and 16), the resulting container 10 will be non square, skewed, or both. If the three markings of third set 84 are not transversely aligned, as described above, with the three markings of fourth set 86, but instead are longitudinally offset (FIG. 16), the resulting container 10 will be non square, skewed, or both. In any case, containers which, upon a simple visual inspection, do not have a properly located and aligned manufacturing joint can be discarded.

Figure 6:
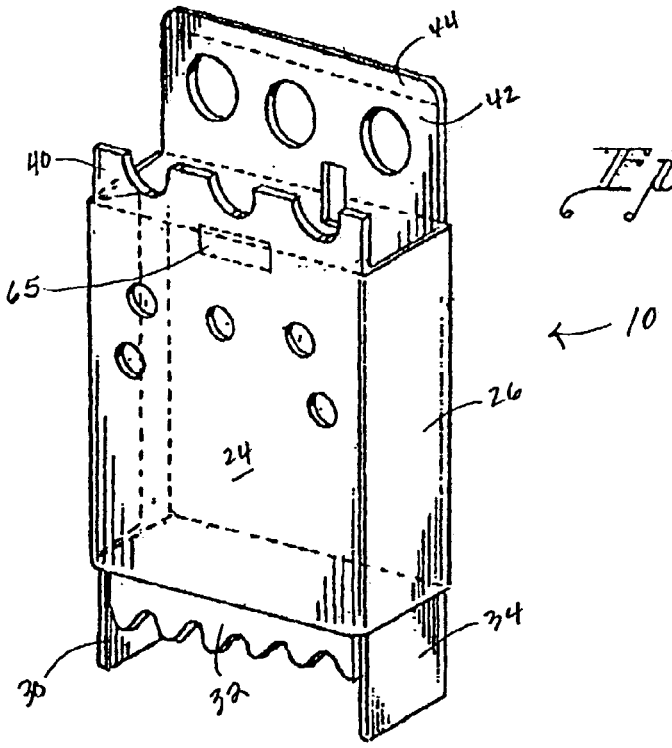
FIG. 6 is a rear perspective view of the container of FIG. 1, showing the container in an erected configuration and the top and bottom flaps prior to folding.

Once the knocked-down container is correctly formed so that the manufacturing joint 25 is properly located and aligned, it can be erected, or opened into a tubular form (FIG. 6) and filled. In order to ensure that the erected container is square and non-skewed, inventive bottom flaps 32, 36 having squaring means are provided.

Front side bottom flap 36 is defined by lower transverse fold line 62 which separates it from front side wall 28, and a free peripheral edge 58 which is opposed to lower transverse fold line 62 and separated from it by the body of the front side bottom flap 36. Rear side bottom flap 32 is defined by lower transverse fold line 62 which separates it from rear side wall 24, and a free peripheral edge 56 which is opposed to lower transverse fold line 62 and separated from it by the body of the rear side bottom flap 32. Free peripheral edge 58 of the front side bottom flap 36 is provided with a thickness and a curvilinear contour. Free peripheral edge 56 of rear side bottom flap 32 is provided with a thickness and a curvilinear contour which is identical to the curvilinear contour of free peripheral edge 58 of front side bottom flap 36, except that the curvilinear contour of free peripheral edge 56 of rear side bottom flap 32 is the negative of the curvilinear contour of free peripheral edge 58 of front side bottom flap 36. That is to say that the contours are identical and shifted relative to one another so that they are 180 degrees out of phase.

Respective rear side bottom flap 32 and front side bottom flap 36 are folded toward each other along the lower transverse fold line 62 to an orientation which is perpendicular to the longitudinal axis of the packaging container such that both respective bottom flaps 32, 36 lie in a single plane. Each respective rear side bottom flap 32 and front side bottom flap 36 are provided in a length that allows the free peripheral edge 56 of rear side bottom flap 32 to abuttingly confront the free peripheral edge 58 of front side bottom flap 36 when folded. Additionally, the contoured arcs of free peripheral edge 56 interlock and engage with the contoured arcs of free peripheral edge 58 so that the respective bottom flaps 32, 36 are prevented from relative motion within the plane of the bottom of the packaging container, and so that respective side walls and end walls of said packaging container are easily formed into and maintained at right angles to and in a non skewed configuration relative to each other. In the preferred embodiment, the respective free peripheral edges 56, 58 are shaped so that the respective free peripheral edges are in mutual contact along their entire length.

Figure 17:
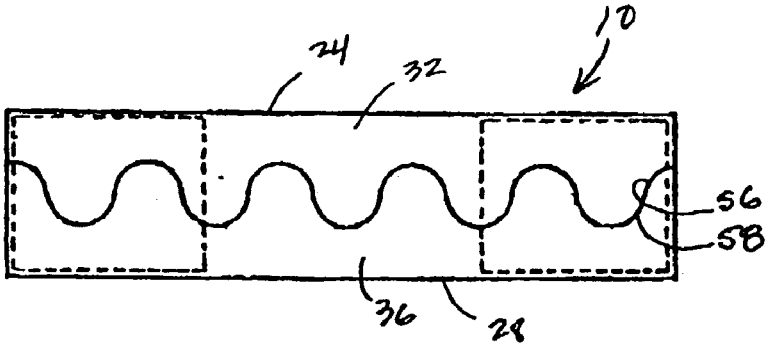
FIG. 17 is a bottom side view of the erected, folded container, illustrating the interlocking relationship of the curved peripheral edges of the bottom major flaps, the bottom minor flaps shown in phantom.

In the preferred embodiment, the curvilinear contour is provided in the shape of a sinuate semicircular arc (FIGS. 5 and 17). However, it is well within the scope of this invention to provide the interlocking curvilinear contour in alternative shapes, including square, arcuate, triangular, or some combination or modification of these shapes. Additionally, the amplitude and frequency of the interlocking shape can be modified to accommodate more or less skew correction as required.

In the preferred embodiment, the peripheral edges 56, 58 of the major bottom flaps (rear side bottom flap 32 and front side bottom flap 36) are provided with the interlocking curvilinear contour. However, it is well within the scope of this invention to provide the peripheral edges 55, 57 of the respective minor flaps (first end bottom flap 30 and second end bottom flap 34) with an interlocking curvilinear contour instead of, or in addition to that of the major bottom flaps.

Referring now to FIGS. 4 and 8–10, innovative features on respective front side 42 and rear side 40 top flaps will now be discussed. Front side top flap 42 is defined by upper transverse fold line 60 which separates it from front side wall 28, and a free peripheral edge 53 which is opposed to upper transverse fold line 60 and separated from it by the body of the front side top flap 42. Front side top flap flange 44 comprises a narrow portion of front side top flap 42 immediately adjacent free peripheral edge 53, and is provided with an indented transverse fold line 64 to permit folding of flange 44 relative to front side top flap 42. Plural circular openings 90 are formed in the body of front side top flap 42 which are sized to allow bottle caps 7 to pass therethrough as front side top flap 42 is folded down to form the top surface of container 10. Front side top flap 42 is provided in a length which allows transverse fold line 64 to overlie the top edge of rear side wall 24 when front side top flap 42 is folded, and which allows flange 44 to fold about transverse fold line 64 so that it overlies and confronts an upper portion of rear side wall 24.

Rear side top flap 40 is defined by upper transverse fold line 60 which separates it from rear side wall 24, and a free peripheral edge 55 which is opposed to upper transverse fold line 60 and separated from it by the body of the rear side top flap 40. Free peripheral edge 55 is provided with plural semicircular openings 92, or crenulations. Openings 92 are sized to receive the necks 7 of bottles 5 therewithin and thus are smaller in dimension than circular openings 90 of front side top flap 42. Rear side top flap 40 is provided in a length which is approximately ⅔ the distance between front side wall 28 and rear side wall 24.

Rear side top flap 40 is partially detached from rear side wall 24 due to die cuts 66, 67 along upper transverse fold line 60 between first longitudinal fold line 70 and second longitudinal fold line 72. Rear side wall 24 is provided with a hinge 65 positioned at transverse fold line 60 mid way between first longitudinal fold line 70 and second longitudinal fold line 72.

Hinge 65 connects rear side wall 24 with rear side top flap 40. It consists of an upper transverse perforation line 68 which coincides with upper transverse fold line 60, and a lower transverse perforation line 69 which lies spaced apart from, parallel to, and below upper transverse perforation line 68. Upper transverse perforation line 68 and lower transverse perforation line 69 each extend along the middle third of the top edge of rear side wall 24, from respective first ends to respective second ends. Each perforation line 68, 69 is provided with evenly space perforations which extend through the thickness of blank 20 from first face 12 to second face 14. Hinge 65 further consists of a first longitudinal cut line 61 which extends between the respective first ends of upper transverse perforation line 68 and lower transverse perforation line 69, and a second longitudinal cut line 63 which extends between the respective second ends of upper transverse perforation line 68 and lower transverse perforation line 69. First 61 and second 63 longitudinal cut lines provide slits in blank 20 which extend through blank 20 from first face 12 to second face 14.

Figure 10:
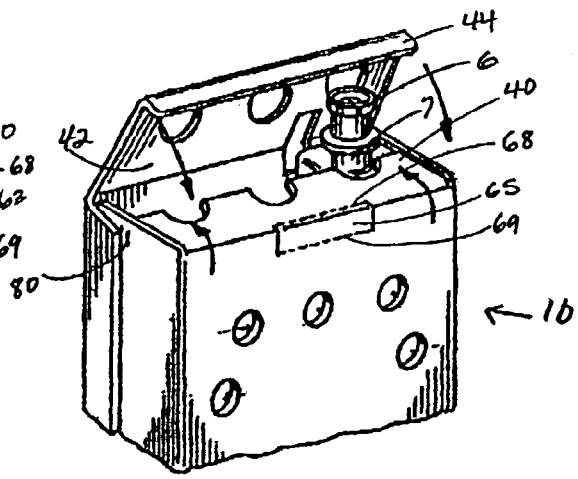
FIG. 10 is a partial rear perspective view of the container of FIG. 1, illustrating the short top flap folded, and illustrating how the bottle caps pass through the circular openings in the tall top flap as the tall top flap is folded down to overlie the short top flap.

Thus, rear side top flap 40 is detached from rear side wall 24 along upper transverse fold line 60 except at hinge 65, which provides a pivotable bridge between rear side wall 24 and rear side top flap 40. In use, rear side top flap 40 is moved laterally outward away from the top edge of rear side wall 20 (FIG. 9) by pivoting about the lower transverse perforation line 69. Then rear side top flap 40 is pivoted about upper transverse perforation line 68 such that rear side top flap 40 lies in the horizontal plane and the semicircular openings 92 can be inserted about and between necks 7 of bottles 5 by urging rear side top flap 40 toward front side wall 28 (FIG. 10). Positioning rear side top flap 40 laterally apart from the rear side wall allows peripheral edge 55 to avoid interference with bottle caps 6 as rear side top flap 40 is folded to the horizontal plane, and eases the insertion of semicircular opening 92 about necks 7 of bottles 5.

Method steps for forming a container which is consistently square and non-skewed to within strict tolerances will now be described.

Figure 3:
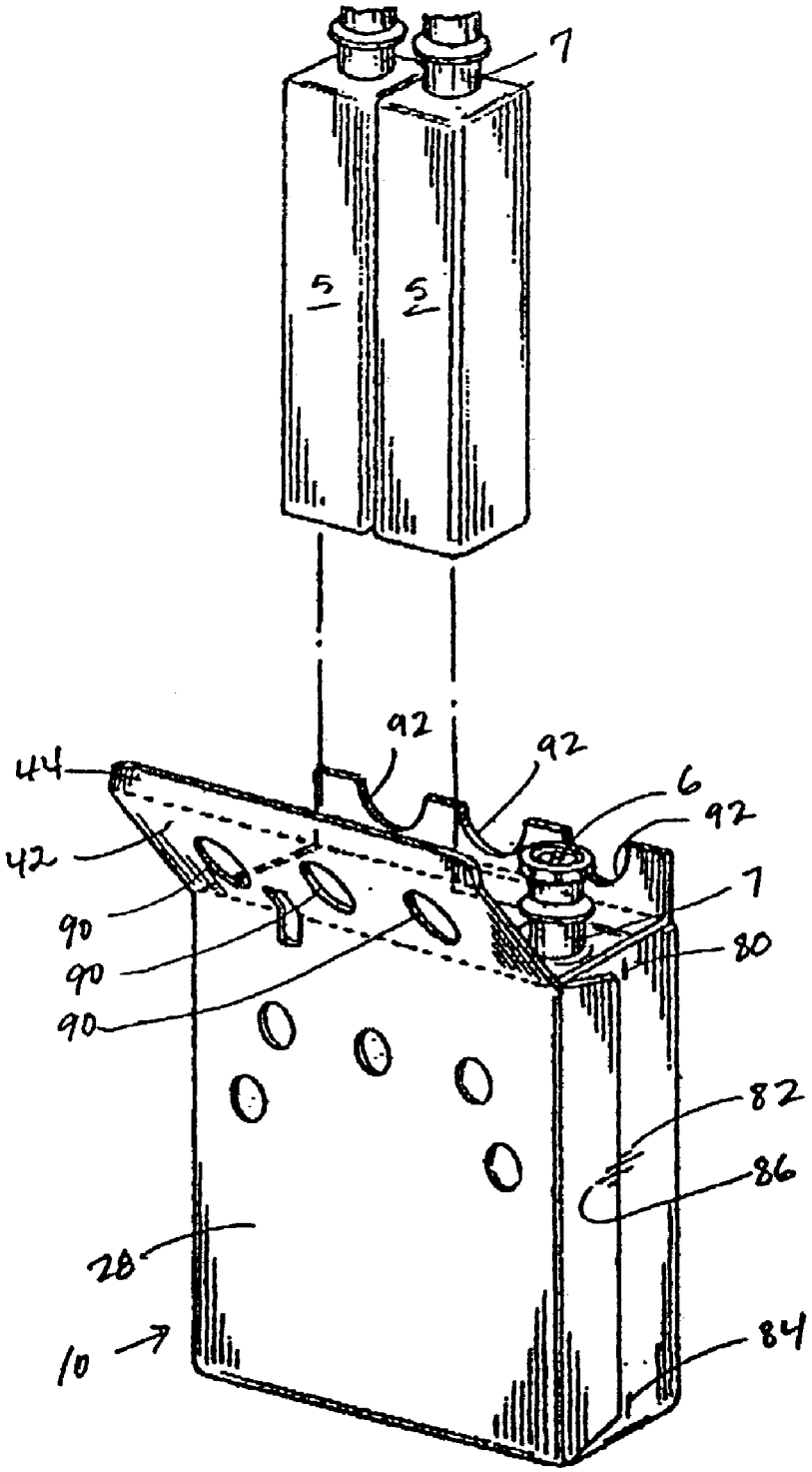
FIG. 3 is a front perspective view of the container of FIG. 1 showing how the container is used to package bottles.
Figure 4:
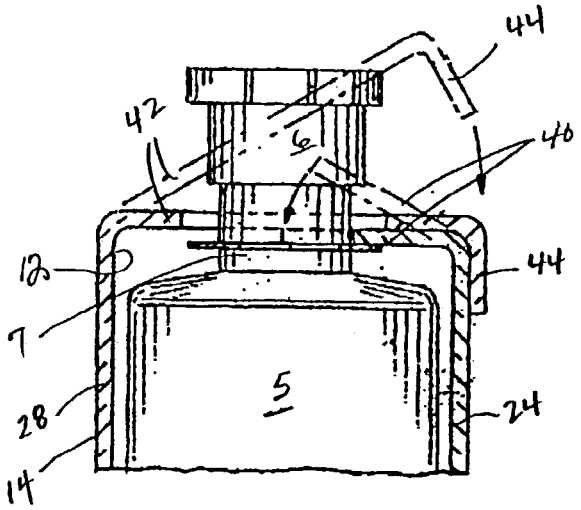
FIG. 4 is a partial side sectional view of the upper portion of the filled container of FIG. 3, illustrating the interrelationship between the two upper flaps, and between the upper flaps and the bottles as the flaps are folded together to close the upper end of the container.
Figure 7:
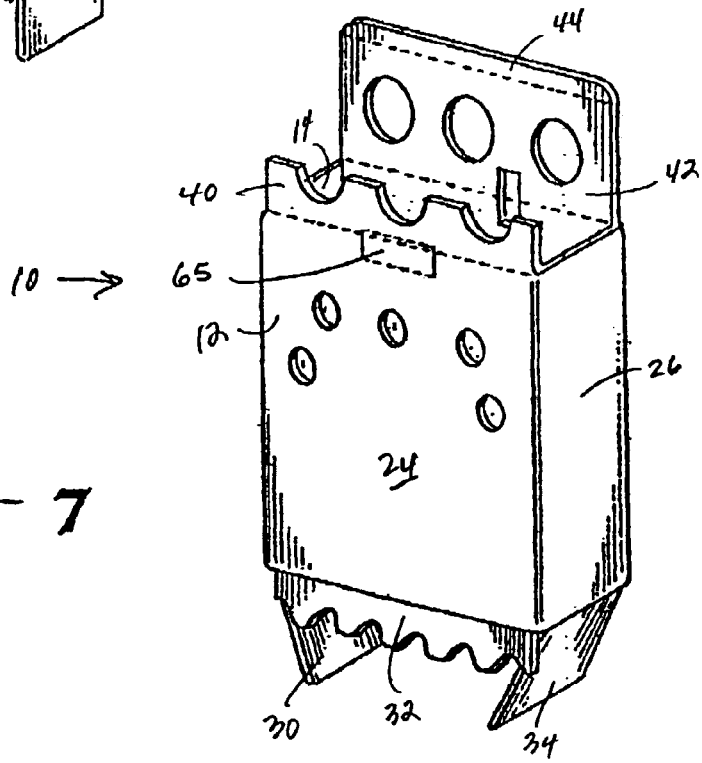
FIG. 7 is a rear perspective view of the container of FIG. 1, showing the upper flaps in a non-folded configuration, and the bottom flaps in a partially folded configuration.
Figure 8:
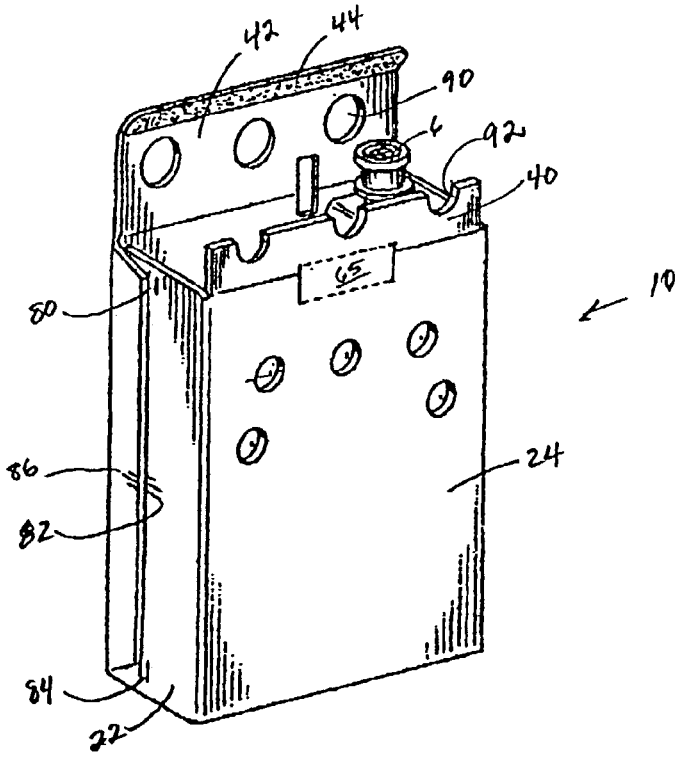
FIG. 8 is a rear perspective view of the container of FIG. 1, illustrating the hinged joint in the short top flap.
Figure 9:
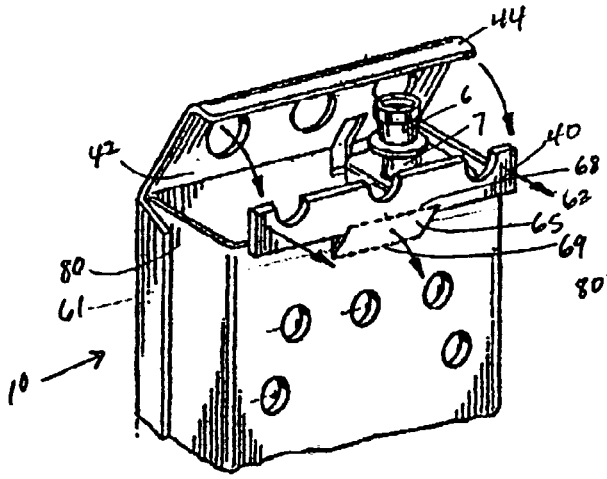
FIG. 9 is a partial rear perspective view of the container of FIG. 1, illustrating how the hinged joint in the short top flap is used to allow the short top flap to be moved away from the top edge of the container prior to folding, allowing easy insertion of the arcuate openings in its peripheral edge about the necks of the bottles.
Figure 11:
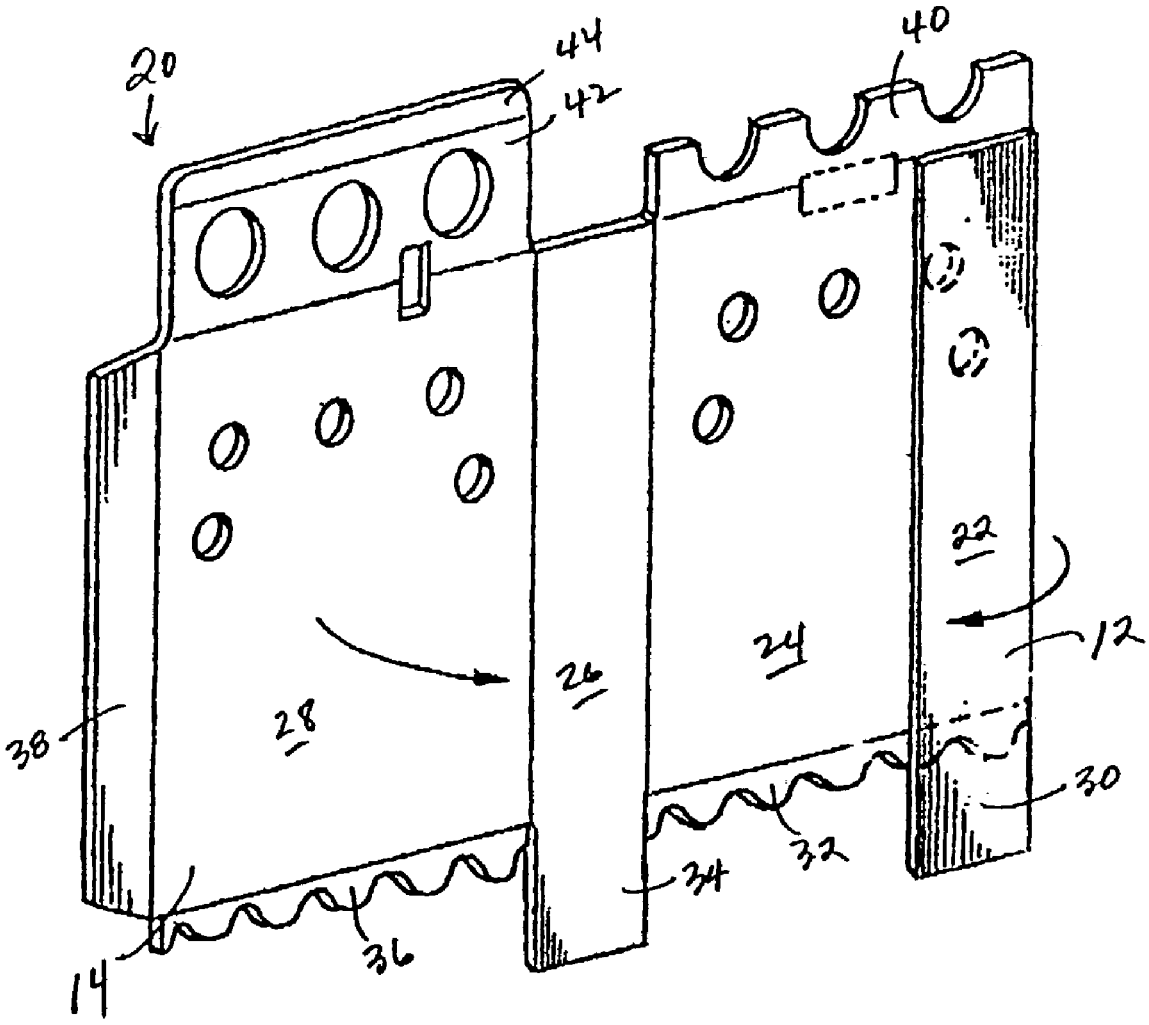
FIG. 11 is a plan view of the blank of FIG. 5 illustrating the leading flap folded back to overlie the body of the blank as a second step in the manufacture of a knocked-down container.

1. Provide a flat sheet of material from which container 10 will be formed.
2. Die cut the flat sheet of container material into blank 20 (FIG. 5).
3. Apply glue to second face 14 of end wall flange 38.
4. Fold blank 20 along first longitudinal fold line 70 so that second face 14 of first end wall 22 overlies and confronts a first portion of second face 14 of rear side wall 24 (FIG. 11).
5. Fold blank 20 along third longitudinal fold line 74 (FIG. 12)
   so that second face 14 of front side wall 28 overlies and confronts both second face 14 of second end wall 26 and a second portion of rear side wall 24, and
   so that second face 14 of end wall flange 38 overlies first face 12 of first end wall 22.
6. Align longitudinal peripheral edge 54 of end wall flange 38 between the cut lines of both the first set 80 and second set 82 of alignment markings (FIG. 13).
7. Align the center line of third set 84 of alignment markings between the upper and lower markings of fourth set 86 of alignment markings, and the center line of fourth set 86 of alignment markings between the upper and lower markings of third set 84 of alignment markings (FIG. 13).
8. Secure second face 14 of end wall flange 38 to first face 12 of first end wall 22 by adhesion of glue to form manufacturing joint 25 on knocked-down container 10 (FIG. 12).
9. Check resulting knocked-down container 10 to insure that end wall flange 38 is correctly positioned relative to each respective first, second, third, and fourth set 80, 82, 84, 86 of alignment markings.
10. Erect knocked down container 10 into an open, hollow tube configuration (FIG. 6).
11. Fold first end bottom flap 30 and second end bottom flap 34 toward each other along lower transverse fold line 62 so that first end bottom flap 30 and second end bottom flap 34 lie adjacent each other in an orientation which is perpendicular to the longitudinal axis of the packaging container (FIG. 7).
12. Fold front side bottom flap 36 and rear side bottom flap 32 toward each other along lower transverse fold line 62 so that front side bottom flap 36 and rear side bottom flap 32 lie adjacent each other in an orientation which is perpendicular to the longitudinal axis of the packaging container.
13. Position rear side bottom flap 32 and front side bottom flap 36 within a single plane so that the curvilinear contour of free peripheral edge 58 of front side bottom flap 36 abuttingly engages and interlocks with the complimentary curvilinear contour of free peripheral edge 56 of rear side bottom flap 32, the resulting interlocked configuration preventing the respective bottom flaps 32, 36 from relative motion within the plane of the bottom of container 10 (FIG. 17).
14. Inserting the container contents into the interior space formed within the open, hollow tube of container 10 such that they rest on respective bottom flaps 30, 34 (FIG. 3).
15. Move rear side top flap 40 laterally outward away from the top edge of rear side wall 24 by pivoting about lower transverse perforation line 69 (FIG. 9).
16. Fold rear side top flap 40 to an orientation which is perpendicular to the longitudinal axis of the packaging container by pivoting inward along upper transverse perforation line 68.
17. Insert crenulated free peripheral edge 55 of rear side top flap 40 toward front side wall 28 so that the crenulations of free peripheral top edge 55 are inserted between and around the upper portions of the package contents (FIG. 10).
18. Fold front side top flap 42 along upper transverse fold line 60 toward rear side wall 24 to an orientation which is perpendicular to the longitudinal axis of the packaging container (FIG. 4).
19. Fold front side top flap flange 44 downward along indented transverse fold line 64 to overlie and confront first face 12 of rear side wall 24 (FIGS. 9 and 10).
20. Seal the folded top and bottom ends of container 10.

I claim:

1. A combination self-squaring packaging container and bottles, wherein the self-squaring container comprises a generally rectangular blank which has been folded and joined along opposing peripheral edges to form a flattened tube, the blank then being subsequent erected to form an elongate, hollow, rectangular tube, the tube having a front side wall, and a rear side wall which is opposed to the front side wall, the tube having a first side wall which joins the front side wall to the rear side wall along a first edge, the tube having a second side wall which joins the front side wall to the rear side wall along a second edge such that the first side wall and the second side wall are opposed and separated from each other by the respective front and rear side wall, the tube comprising a front side top flap which is hingedly secured to an upper edge of the front side wall, a rear side top flap which is hingedly secured to an upper edge of the rear side wall, a front side bottom flap which is hingedly secured to a lower edge of the front side wall, a rear side bottom flap which is hingedly secured to a lower edge of the rear side wall, an interior space defined, and separated from the exterior, by the respective front side wall, rear side wall, first side wall, and second side wall, a longitudinal axis which is aligned with the vertical, and a transverse axis which lies perpendicular to the longitudinal axis, wherein each of said bottles comprises an elongate body portion, the body portion comprising a longitudinal axis which is aligned with the vertical when the bottle is upright, an upper end, and a lower end, a necked portion defined by a narrowing of the body portion adjacent to the upper end of the bottle, the necked portion having a lower end adjacent the body portion and having an upper end which is opposed to the lower end and coincides with the upper end of the bottle, and a cap portion, wherein the cap portion resides upon and surrounds the upper end of the neck portion, wherein said bottles reside within the interior space of said tube such that the longitudinal axis of the body lies in parallel to the longitudinal axis of the tube, the body portions of the bottles having a height which is generally the same as that of the respective side walls of the tube so that the necked portions extend above the upper edge of the tube when the bottles reside therewithin, wherein the bottom flaps of each respective front and rear side are provided with squaring means, and wherein the rear top flap is provided with bottle support means, said front side bottom flap comprises a first free peripheral edge which lies generally parallel to a transverse axis of said container, said rear side bottom flap comprises a second free peripheral edge which lies generally parallel to a transverse axis of said container, said squaring means comprises said first and second free peripheral edges comprising a curvilinear contour, said front side bottom flap and said rear side bottom flap being provided in a length that allows said first free peripheral edge to abuttingly confront said second free peripheral edge when respective rear side wall bottom flap and front side wall bottom flap are folded toward each other to an orientation which is perpendicular to the longitudinal axis of the packaging container such that both respective bottom flaps lie in a single plane.

the curvilinear contour of said first free peripheral edge interlocking and engaging with the curvilinear contour of said second free peripheral edge so that the respective rear side wall bottom flap and front wide wall bottom flap are prevented from relative motion within said plane, and so that respective opposing side walls and opposing end walls of said packaging container are easily formed into and maintained at right angles to and in a non skewed configuration relative to each other, and the lower end of the body portion of the bottles resting on the interlocked front side and rear side bottom flaps, the rear side wall is provided with pivoting means which connects the rear side wall with the rear side top flap, wherein the rear side top flap is generally disconnected from said rear side wall by cutting said blank between said rear top flap and said upper edge of said tube, the pivoting means comprising a first transverse perforation line which coincides with said upper edge of said tube, the first transverse perforation line extending from a first end to a second end, a second transverse perforation line which lies spaced apart from, parallel to, and below said first transverse perforation line, the second transverse perforation line extending from a first end to a second end, a first longitudinal cut line which extends between the respective first ends of the first and second transverse perforation lines, said first longitudinal cut line providing a slit in said blank which extends through the thickness of said blank, and a second longitudinal cut line which extends between the respective second ends of the first and second transverse perforation lines, said second longitudinal cut line providing a slit in said blank which extends through the thickness of said blank so that when in use, the rear side top flap moves laterally outward away from the top edge of the rear side wall by pivoting about the second transverse perforation line, and then the rear side top flap is foldable to an orientation which is perpendicular to the longitudinal axis of the packaging container by folding inward along the first transverse perforation line.

2. A combination self-squaring packaging container and bottles, wherein the self-squaring container comprises a generally rectangular blank which has been folded and joined along opposing peripheral edges to form a flattened tube, the blank then being subsequent erected to form an elongate, hollow, rectangular tube, the tube having a front side wall, and a rear side wall which is opposed to the front side wall, the tube having a first side wall which joins the front side wall to the rear side wall along a first edge, the tube having a second side wall which joins the front side wall to the rear side wall along a second edge such that the first side wall and the second side wall are opposed and separated from each other by the respective front and rear side wall, the tube comprising a front side top flap which is hingedly secured to an upper edge of the front side wall, a rear side top flap which is hingedly secured to an upper edge of the rear side wall, a front side bottom flap which is hingedly secured to a lower edge of the front side wall, a rear side bottom flap which is hingedly secured to a lower edge of the rear side wall, an interior space defined, and separated from the exterior, by the respective front side wall, rear side wall, first side wall, and second side wall, a longitudinal axis which is aligned with the vertical, and a transverse axis which lies perpendicular to the longitudinal axis, wherein each of said bottles comprises an elongate body portion, the body portion comprising a longitudinal axis which is aligned with the vertical when the bottle is upright, an upper end, and a lower end, a necked portion defined by a narrowing of the body portion adjacent to the upper end of the bottle, the necked portion having a lower end adjacent the body portion and having an upper end which is opposed to the lower end and coincides with the upper end of the bottle, and a cap portion, wherein the cap portion resides upon and surrounds the upper end of the neck portion, wherein said bottles reside within the interior space of said tube such that the longitudinal axis of the body lies in parallel to the longitudinal axis of the tube, the body portions of the bottles having a height which is generally the same as that of the respective side walls of the tube so that the necked portions extend above the upper edge of the tube when the bottles reside therewithin, wherein the bottom flaps of each respective front and rear side are provided with squaring means, and wherein the rear top flap is provided with bottle support means, said front side bottom flap comprises a first free peripheral edge which lies generally parallel to a transverse axis of said container, said rear side bottom flap composes a second free peripheral edge which lies generally parallel to a transverse axis of said container, said squaring means comprises said first and second free peripheral edges comprising a curvilinear contour, said front side bottom flap and said rear side bottom flap being provided in a length that allows said first free peripheral edge to abuttingly confront said second free peripheral edge when respective rear side wall bottom flap and front side wall bottom flap are folded toward each other to an orientation which is perpendicular to the longitudinal axis of the packaging container such that both respective bottom flaps lie in a single plane, the curvilinear contour of said first free peripheral edge interlocking and engaging with the curvilinear contour of said second free peripheral edge so that the respective rear side wall bottom flap and front wide wall bottom flap are prevented from relative motion within said plane, and so that respective opposing side walls and opposing end walls of said packaging container are easily formed into and maintained at right angles to and in a non skewed configuration relative to each other, and the lower end of the body portion of the bottles resting on the interlocked front side and rear side bottom flaps, the rear side wall is provided with pivoting means which connects the rear side wall with the rear side top flap, wherein the rear side top flap is generally disconnected from said rear side wall by cutting said blank between said rear top flap and said upper edge of said tube, the pivoting means comprising a first transverse perforation line which coincides with said upper edge of said tube, the first transverse perforation line extending from a first end to a second end, a second transverse perforation line which lies spaced apart from, parallel to, and below said first transverse perforation line, the second transverse perforation line extending from a first end to a second end, a first longitudinal cut line which extends between the respective first ends of the first and second transverse perforation lines, said first longitudinal cut line providing a slit in said blank which extends through the thickness of said blank, and a second longitudinal cut line which extends between the respective second ends of the first and second transverse perforation lines, said second longitudinal cut line providing a slit in said blank which extends through the thickness of said blank so that when in use, the rear side top flap moves laterally outward away from the top edge of the rear side wall by pivoting about the second transverse perforation line, and then the rear side top flap is foldable to an orientation which is perpendicular to the longitudinal axis of the packaging container by folding inward along the first transverse perforation line, said necked portions of said bottles have a first diameter, and said capped portions of said bottles comprise a second diameter which is greater than said first diameter, wherein said rear side top flap comprises a free peripheral edge which lies generally parallel to and spaced apart from said upper transverse fold line by the body of said rear side top flap, the free peripheral edge of said rear side top flap comprising a plurality of crenulations which are sized of said first diameter so as to receive the necked portions therein, such that when in use, the crenulated free peripheral edge of the rear side top flap is inserted toward front side wall so that the crenulated free peripheral top edge lies between and surrounding said package contents, and below said bottle caps, thus providing a lateral stabilizing support to the necked portions of the bottles.

* * * * *